United States Patent [19]

Elspass

[11] Patent Number: 4,648,305

[45] Date of Patent: Mar. 10, 1987

[54] ARMORED VEHICLE FOR SUPPLYING AMMUNITION TO A SELF-PROPELLED ARTILLERY WEAPON

[75] Inventor: Marold Elspass, Kaarst, Fed. Rep. of Germany

[73] Assignee: Rheinmetall GmbH, Duesseldorf, Fed. Rep. of Germany

[21] Appl. No.: 644,067

[22] Filed: Aug. 24, 1984

[30] Foreign Application Priority Data

Sep. 7, 1983 [DE] Fed. Rep. of Germany ..... 3332225

[51] Int. Cl.[4] ..... F41H 7/02; F41F 9/00; F41F 9/02

[52] U.S. Cl. ..... 89/36.08; 89/40.07; 89/45

[58] Field of Search ..... 89/36.08, 40.03, 40.07, 89/40.16, 45, 46, 47

[56] References Cited

U.S. PATENT DOCUMENTS

| | | | |
|---|---|---|---|
| 2,339,334 | 1/1944 | Heaslet | 180/9.1 |
| 2,830,499 | 4/1958 | Even | 89/47 |
| 4,065,999 | 1/1978 | Hultgren et al. | 89/36 H |
| 4,236,441 | 12/1980 | Turner et al. | 89/40 F |
| 4,391,179 | 7/1983 | Tidstrom | 89/46 |

*Primary Examiner*—Herbert B. Guynn
*Assistant Examiner*—Eric Jorgensen

[57] ABSTRACT

An improved self-propelled vehicle used for transporting ammunition. Ammunition is moved by a motor driven conveyor having elevating means for selectively vertically moving ammunition units stored in the vehicle.

17 Claims, 13 Drawing Figures

ARMORED VEHICLE FOR SUPPLYING AMMUNITION TO A SELF-PROPELLED ARTILLERY WEAPON

BACKGROUND OF THE INVENTION

The invention relates to an armored vehicle for a self-propelled artillery weapon having conveying means for ammunition and the gun crew. Such arrangements are known in the state of the art and are, for example, described in U.S. Pat. No. 4,236,441.

In such known arrangement a self-driven ammunition and gun crew vehicle is prepared. The ammunition is transferred as the need arises onto a separate conveyor. However, this operation can not be effected without manual intervention by a crew member. In such known arrangement it is therefore necessary to transport each ammunition unit from a storage position onto a tray which is operatively connected to a motorized elevator which transfers the ammunition unit onto a conveyor belt which in turn transports the ammunition unit to the self-propelled gun. The afore-described steps in this known arrangement can not be effected without the manual intervention of a crew member. Because of the required manual handling with this known arrangement there can only be loaded a limited number of ammunition units during a predetermined loading time onto the weapon carrier which also limits the shortening of the loading time for the artillery weapon. Moreover, this known arrangement lacks armor protection outside of the armored vehicle so that no separate armor protection is provided for the ammunition units during the transfer from the armored storage vehicle to the armored weapons carrier vehicle proper which usually carries a self-propelled gun. This lack of armor-protection is dangerous for the gun crew. The ammunition units are stored horizontally in the armored storage vehicle in a plurality of stacks. At least a portion of these horizontally stored ammunition unit stacks are arranged transversely with respect to the direction of travel of the vehicle. The individual ammunition units are stored in separate cylindrical containers from which they must be pulled out before the can be placed on the elevator. In order to transport a large number of ammunition units with this known arrangement it is necessary to stack the individual ammunition units from the floor up to the ceiling of the armored storage vehicle which a causes an unfavorable upward displacement of the center of gravity of the armored storage vehicle. Moreover, the armored ammunition storage vehicle when fully loaded becomes more vulnerable to a direct hit. Due to the fact that at least one separate crew member is required for servicing the conveying means of the arrangement and further that such crew member must be accommodated in the crew's quarters causes a reduction of personnel available for firing and other combat functions. Also there is no separate fuel storage tank provided for the armored ammunition storage vehicle. Due to the fact that the crew quarters for the driver are disposed forwardly and the spend ammunition shell ejection opening is disposed rearwardly of the armored vehicle the docking procedure with a separate armored weapons carrier vehicle can only be carried out indirectly.

SUMMARY OF THE INVENTION

It is a general object of this invention to provide an improved armored vehicle of the afore described type in which the storage chamber for the ammunition units is arranged in such a way in the armored vehicle that a quick ammunition exchange between a separate ammunition transport vehicle and a separate armored weapons carrier vehicle is possible with full armor protection. The construction of the armored storage vehicle of this invention is such that with the same spatial vehicle requirements the quantity of the transported ammunition as well as the number of the crew can be increased. The transport of the additional means for the separate ammunition storage vehicle is provided for. Also by virtue of a favorable center of gravity location the vehicle when loaded behaves better in motion and its vulnerability as result of a direct hit is decreased.

In the arrangement of the invention the storage chamber for the ammunition is disposed in the middle region of the vehicle relative to the longitudinal axial direction of the vehicle. This advantageously places the center of gravity deep down in the vehicle and provides for a very stable riding. Moreover, there are provided one or more elevating mechanisms for the ammunition which are movable in the longitudinal axial and transverse directions effecting a transport of the ammunition over the storage chamber, whereby the ammunition can be automatically taken from the storage chamber in any preselected sequence. The arrangement of the invention provides furthermore for the transport of the ammunition units by means of one or more (preferably two) slidably automatically working transport mechanisms which are fully armor-protected and transport the ammunition units to a separate armored weapons carrier vehicle at the front side of the vehicle. Thus there are attained with the novel arrangement of this invention relatively short uniform loading times due to the fully automatic ammunition flow via elevating and transport mechanisms, which dispense with the manual handling by the crew thereby avoiding the fatigue factor. This applies particularly to the situation when the ammunition is simultaneously conveyed via two independently operating elevating and transporting mechanisms to the weapon carrier.

There is disposed an operations control chamber above the storage chamber for the ammunition. Room is also provided above the storage chamber for the elevating mechanism which disposition permits the formation of a supplemental crew chamber in the armored vehicle, whereby, with the exception of the required space for the elevating mechanism, the entire upper surface of the storage chamber can be used for this purpose. As a result of locating the additional crew chamber above the storage chamber i.e. in an elevated position but at the front of the vehicle, it is easy for the crew in the supplemental crew chamber to dock the armored vehicle rapidly without any problems to the weapon carrier vehicle for purposes of transferring ammunition.

By dividing the storage chamber preferably into a forward and a rear region, there results a favorable riding characteristic for the armored vehicle and additionally a high loading possibility, whereby when cartridged ammunition is used the heavy cartridges are stored in the forward region and with divided ammunition the projectiles are also stored in the forward region. An additional advantage results from the arrangement of the invention by virtue of the fact that, taking into consideration the armor protection and the power of the driving unit, there can, nevertheless, be achieved a favorable output weight (total weight/useful weight).

By storing the ammunition in exchangeable containers which are open on top and are in the form of prisms there results a further advantage of, permitting on the one hand a quick access to the ammunition by means of the elevating mechanism, and on the other hand a simple and rapid exchange can be effected of identical standardized containers. A slidable displaceable container-cover distinguishes itself advantageously in that, during the transporting it affords, in addition to a protective function for the ammunition, also the function of a floor for the crew chamber and prior to the initiation of the ammunition loading process it is telescopically slidably collapsible in a simple manner.

The crew chamber provides advantageously in side by side partial chambers a seating position for the driver, a seat and standing position for the commander of the vehicle and a further seating position for the additional crew member, whereby the servicing of the transporting and elevating mechanisms can only be effected by the driver or by the commander. The increased space that is made available by the elevated arrangement of the crew chamber permits the disposition of an additional fuel tank, which could be used for example to supply the weapons carrier as well as auxiliary driving mechanisms mounted in the vehicle itself.

A further features resides in the manner of operation and installation of the elevating mechanism which also acts as a lifting member that is mounted on a bridge crane that is movable over a pair of stationary rails that are mounted respectively on both side walls of the vehicle, whereby on the traverse of the bridge crane in a direction transverse to the vehicle there is arranged a separate drivable carriage, on which the elevating mechanism and the control and drive units for driving the carriage and the elevating mechanism are arranged. The elevating mechanism can thereby, for grasping ammunition stored in prone positions in the containers at their lower ends, be constructed as a grip arrangement, or when the ammunition is stored in the containers in the vertical position operate as a gripping and swinging arrangement. The gripping and swinging arrangement furnishes the possibility to lift randomly selected vertically stored ammunition, in accordance with a control program or individually singly and to swing this ammunition into a horizontal put-away position, whereas by means of the grip arrangement there can eventually be lifted two pieces of prone stored ammunition simultaneously and be delivered in a timedelayed fashion. With prone stored ammunition there results in addition to this simplified operation the renewed supply, lifting and delivering of further prone stored ammunition during inaction of the traverse, whereby a comparatively substantially reduced operating time is achieved.

For speeding up the transporting of the ammunition during the emptying of the containers every region of the storage chamber is emptied by means of an elevating mechanism of a corresponding separately arranged bridge crane, whereby the bridge cranes are jointly or separately movable over the forward and rear region. Identical vertically or prone stored ammunition can be immediately driven out, whereas different erect or prone stored ammunition in the corresponding regions is lifted by a bridge crane which is provided with a gripping arrangement for this purpose and another bridge crane is provided with a gripping and swinging arrangement for this purpose.

Arranging a swingably movable transport arrangement at each bridge crane which is drivable reciprocably on a separate sled there is achieved an accelerated ammunition transfer, whereby the ammunition transfer can be preponderantly effected under CBR chemical-biological-radiation protection as a result of a slidable or swingably movable locking flap which is mounted on the front side of the vehicle for the conveying or transporting arrangement and which includes a flap opening and has on the exterior side of the vehicle a projecting gun barrel. Even when the energy supply for the bridge crane is interrupted there still can be effected a transportation of the ammunition from the containers onto the transport arrangement by means of special tools which carry their own energy supply.

According to a further feature of the invention the docking process of the ammunition supply vehicle to the weapons carrier vehicle while under armored protection can be carried out by sensors, whereby the docking process is already initiated when the two vehicles are still a distance of a plurality of meters apart from each other. Thereby it is possible, to carry out timely angular planar and elevation deviation adjustments for achieving an exact docking point.

BRIEF DESCRIPTION OF THE DRAWINGS

For an understanding of the principles of the invention, reference is made to the following description of a typical embodiment thereof as illustrated in the accompanying drawings.

Detailed Description

Figure 1:
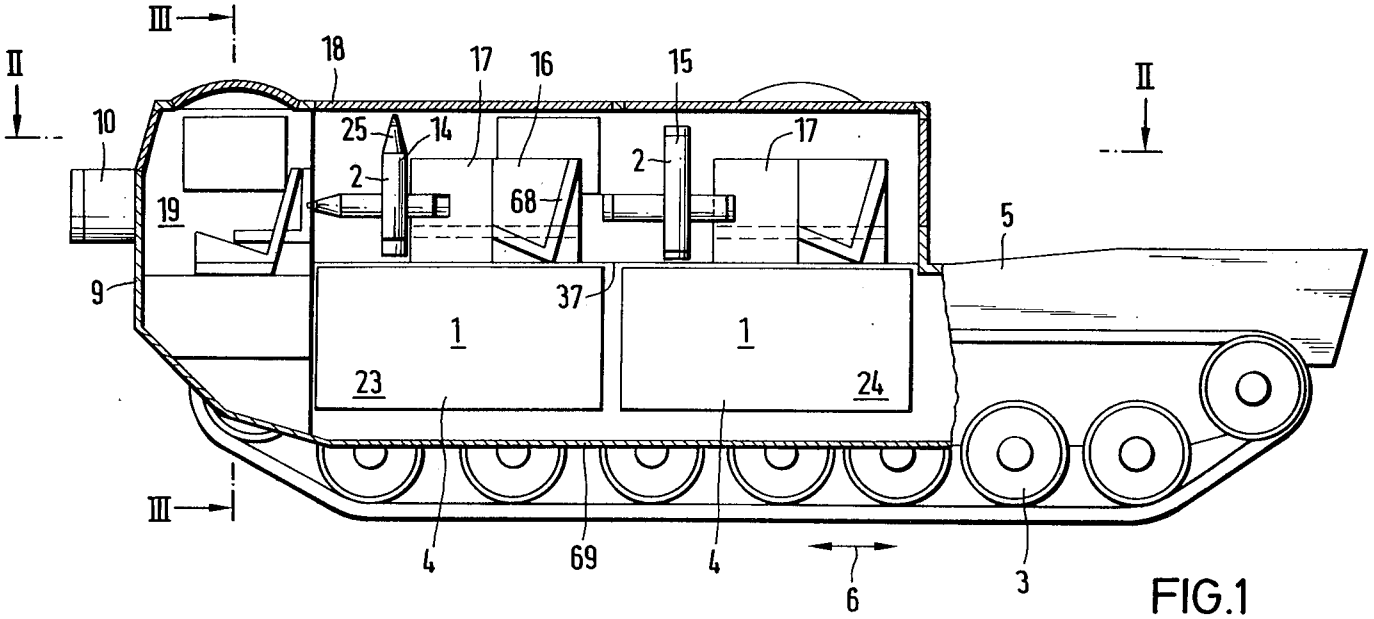
FIG. 1 is a longitudinal sectional view along the plane I—I of FIG. 2 which illustrates the armored vehicle together with the arrangement of the storage, crew and operations control chambers.
Figure 2:
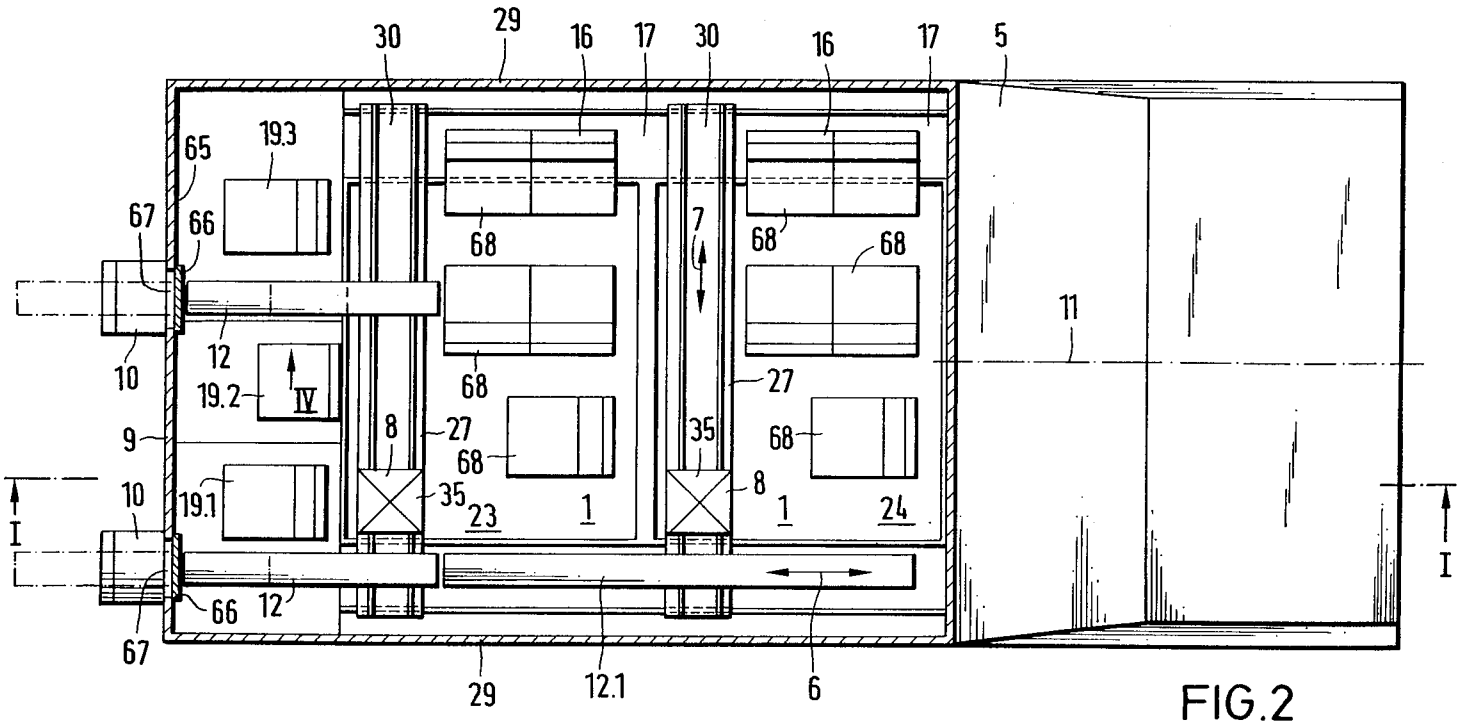
FIG. 2 is a cross-sectional view along the plane II—II of FIG. 1 which illustrates the elevating and transporting arrangements as well as the operations control and crew chambers.
Figure 3:
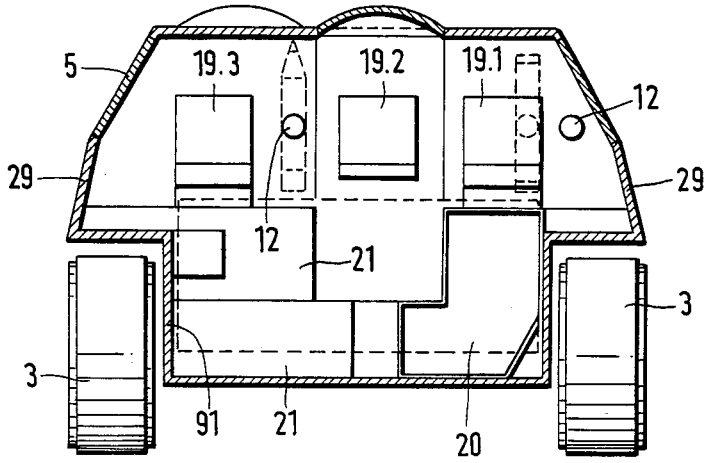
FIG. 3 is a cross-sectional view along plane III—III illustrating the crew chamber and an auxiliary tank arranged thereunder as well as additional auxiliary mechanisms.
Figure 6:
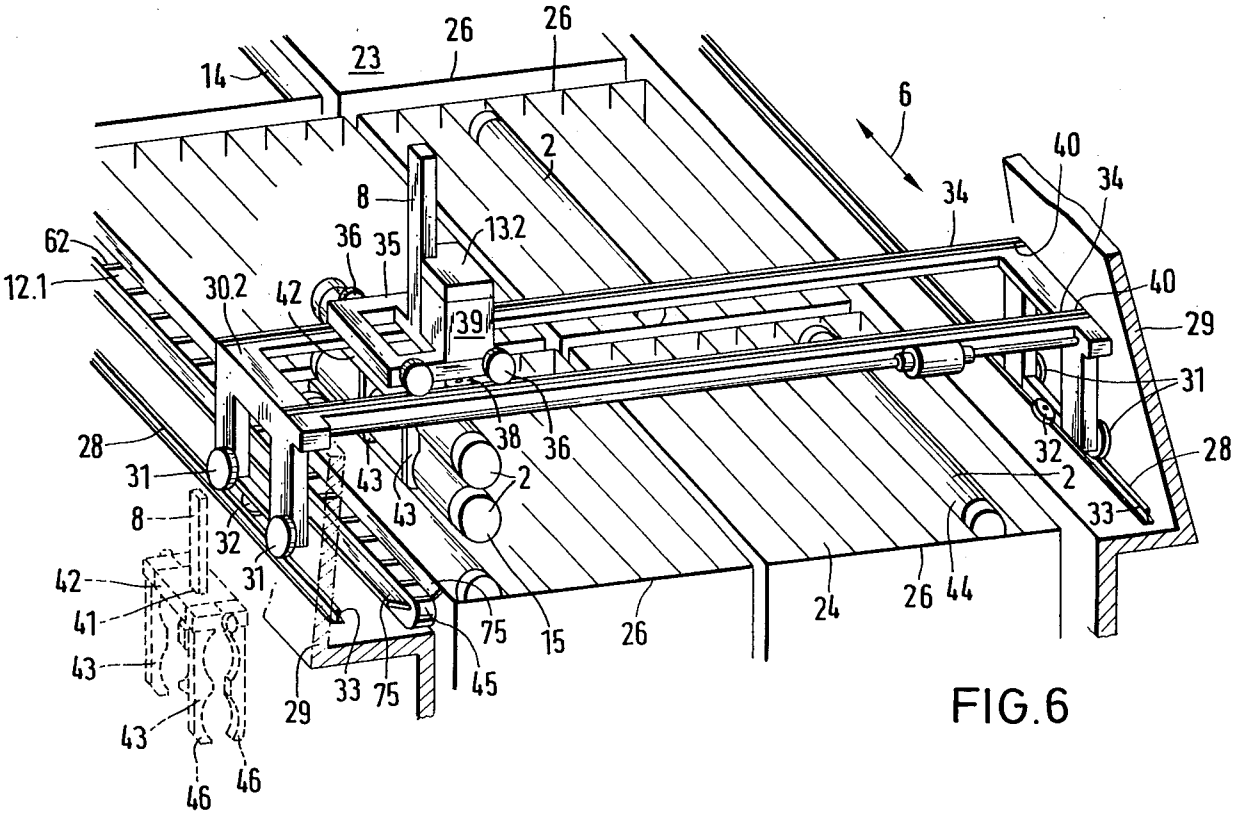
FIG. 6 is a perspective partially cross-sectional view of the storage chamber with prone stored containers in which ammunition is stored and illustrating a bridge crane arranged above the stored ammunition and a laterally arranged stationary transport arrangement.

Referring now to the drawings there is illustrated in FIGS. 1 to 3 the construction of an armored tracked vehicle 5 which performs the function of an ammunition and crew transport vehicle, whereby the construction can also be that of an armored wheeled vehicle. The vehicle 5 is casemate-shaped in its forward end middle region and it contains in the rear region identical drive units for a weapons carrier, for example a tank howitzer. The lower region 4 located between the driving wheels 3 of the vehicle 5 is used exclusively as a storage chamber 1 for the ammunition 2, whereby the storage chamber 1 is disposed with respect to the travel direction 6 approximately in the middle of the vehicle 5. There are mounted two elevating mechanisms 8 above the storage chamber 1 which are movable in the travel direction 6 as well as in a transverse direction 7 within the vehicle 5 for lifting the ammunition 2 from the storage chamber 1 and for delivering it to two separate transport arrangements 12. The separately movable transport arrangements 12 are also mounted above the storage chamber 1 and are, during the transportation of ammunition towards a separate weapons carrier 70 (FIG. 11), slidably displaced parallel to the longitudinal vehicle axis 11 alternately through openings in the front wall 9. There is provided above and in front of the storage chamber 1 a crew chamber 19 which is defined by the front wall 9 and the vehicle roof 18. This crew chamber 19 is divided into different partial chambers 19.1 to 19.3. The partial crew chamber 19.1 serves for providing a seat for the driver. Partial crew chamber 19.2 serves for providing a seat and standing position for the commander and partial crew chamber 19.3 serves for a further seat of an auxiliary crew member. The chamber formed by the partial crew chambers 19.1 and 19.2 is preferably bilaterally limited by a transport arrangement 12, whereby an arrangement having only a unilaterally disposed transport arrangement 12.1 is possible and such an arrangement is illustrated in FIG. 6. The space disposed below the crew chamber 19 contains a auxiliary tank 20 as well as auxiliary mechanisms 21, whereby the auxiliary tank is of such dimension that it can receive the entire fuel supply for a separate weapons carrier vehicle. The upper side or roof of the storage chamber 1 is protected by an armored cover 37 so that when the vehicle enters a combat zone this cover 37 protects the ammunition 2 against soiling and other damages. The cover 37 is telescopically slidably movable. The operations control chamber 16 for the lifting mechanisms 8, disposed between the armored cover 37 and the vehicle roof 18, forms with the exception of the spatial requirements of the lifting mechanisms 8, during operation of the vehicle an auxiliary crew chamber 17. Within this auxiliary crew chamber 17 there are provided foldable seats 68 which, when the crew has left this auxiliary crew chamber, can be affixed to the side walls 29 in a non-illustrated manner.

Figure 7:
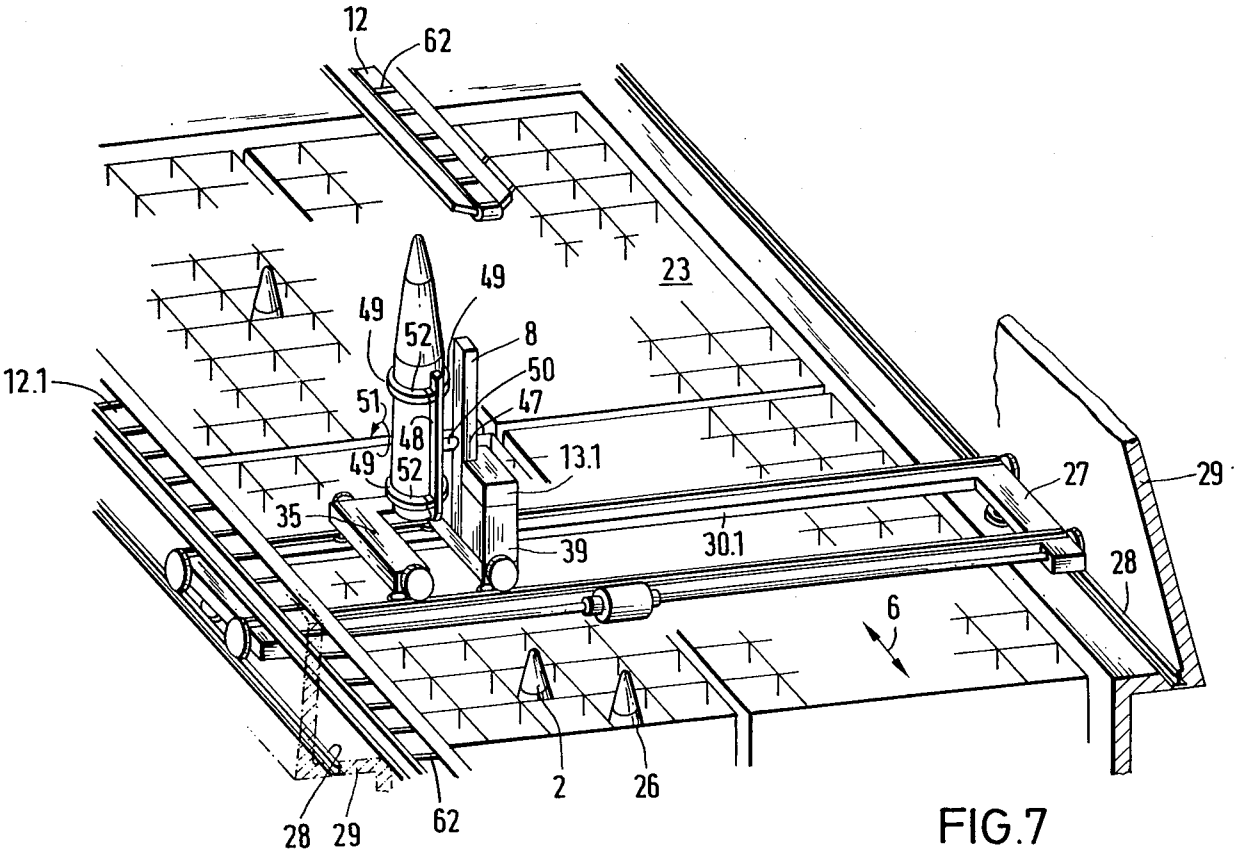
FIG. 7 is a perspective partially cross-sectional view of the storage chamber in which erect stored containers are shown with ammunition mounted therein, with a bridge crane mounted thereabove and having lateral and centrally arranged transport arrangements.
Figure 11:
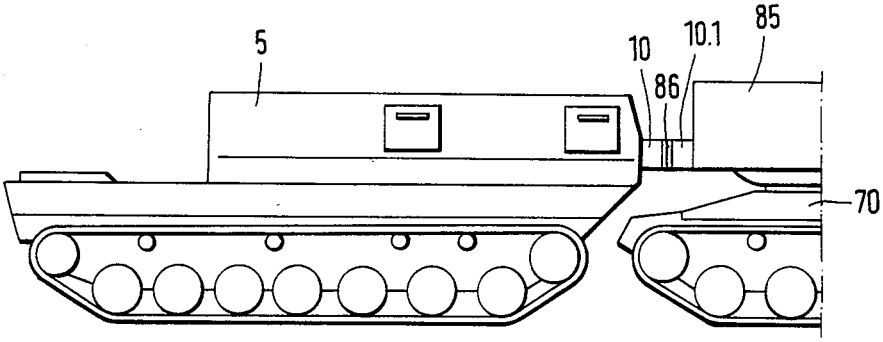
FIG. 11 illustrates the ammunition transport armored a.t.a. vehicle in sideelevational view in a docked condition with respect to a separate weapons carrier vehicle

The storage chamber 1 includes, with respect to the travel direction 6, a forward region 23 and a rear region 24, whereby the cartridged ammunition 2 is divided in such a way that the heavy cartridges 25, and in case of divided ammunition 2, the projectiles 14, are disposed in the forward region 23. During operation of the vehicle there are disposed in the rear region 24 cartridge ammunition 2 of the lighter cartridges and, in the event divided ammunition is used, the propellant charges 15 are stored in this area. The projectiles 14 and the propellant charges 15, respectively cartridges 25 are, for simplifying the transportation thereof, mounted in prism-shaped and exchangeable containers 26 in the regions 23, 24 of the storage chamber 1 (FIGS. 6 and 7). These containers 26 are usually open on the top. The projectiles 14, propellant charges 15 and cartridges 25 are shaped and sized so as to fit into the exchangeable-container 26 (FIG. 6 and 7), and are in a non-illustrated manner supported on the bottom plate 69 of the vehicle 5, whereby the containers 26 (FIGS. 6 and 7) serve for securely holding the ammunition 2 in place during jarring by means of non-illustrated devices. The elevating mechanism 8 is constructed as a piston-stroke operating mechanism which is mounted on a pair of rails which are affixed on the opposite side walls 29 of the vehicle 5 (FIGS. 6 and 7). This elevating mechanism 8 includes a bridge crane 27 which incorporates a traverse 30 which moves in the longitudinal vehicle direction 6 on the rails 28 (see FIGS. 6 and 7) and which also includes the carriage 35 which supports the elevating mechanism 8 and which is movable in the vehicle transverse direction 7 on the traverse 30. The ammunition 2 stored in the storage chamber 1 can be transported by the bridge crane 27 or a plurality of bridge cranes 27, whereby, however, preferably the arrangement illustrated in FIG. 2 is used because in such arrangement a bridge crane 27 is provided for each region 23 and 24 of the storage chamber. The vertically stored ammunition 2 which has been lifted by the forward bridge crane 27 from the space arranged between the crew chambers 19.2 and 19.3 and is conveyed to the weapons carrier 70 (FIG. 11). The ammunition 2 which is stored in a prone position and the vertically stored ammunition 2 which is lifted by the rear bridge crane 27 reach first, for purposes of being conveyed further by the slidably movable transport arrangement 12 arranged on the side wall 29, a stationary portion 12.1 of the transport arrangement 12. Both of the transport arrangements 12 are pushed out, when conveying ammunition to the weapons carrier 70 (FIG. 11), through the openings 67 towards the weapons carrier 70 (FIG. 11), whereby the opening 67 are opened by either pivoting the respective closing flap 66 for this purpose, or opening by sliding the respective flap which flap is slidably arranged on the inner side 65 of the forward wall 9 of the vehicle 9 or is in the form of a swingable closing flap 66 which can be opened simply by pivoting them outwardly.

Even outside of the vehicle the ammunition transfer is carried out under full armor protection because the transport arrangement 12 is protected by the pipes 10 and 10.1 disposed outside of the vehicle 5 and the weapons carrier 70 (FIG. 11) and thereby protects the ammunition transfer (FIG. 11).

Figure 4:
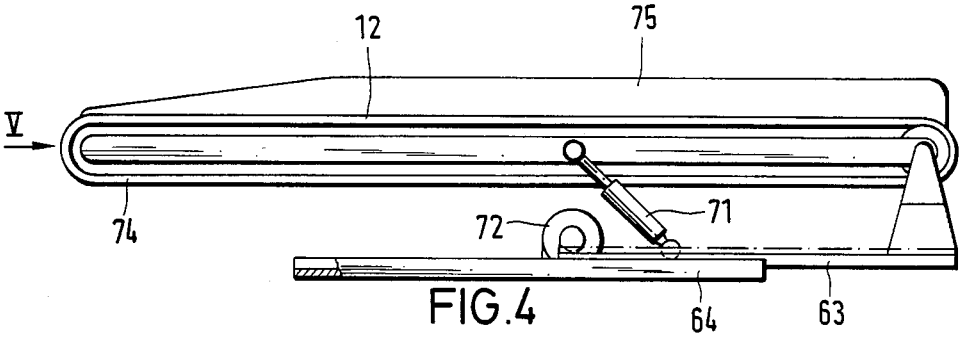
FIG. 4 is a side-elevational view in the direction of the arrow IV in FIG. 2 of the slidably movable transport arrangement.
Figure 5:
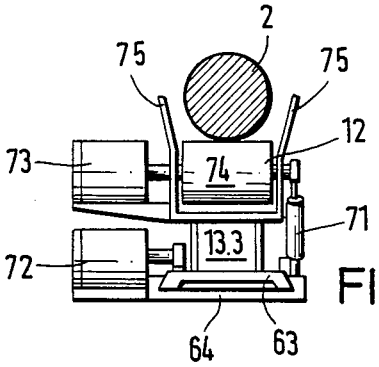
FIG. 5 is a front-elevational view of the slidably movable transport arrangement in the direction of the arrow V in FIG. 4.

The transport arrangement 12 illustrated in FIGS. 4 and 5 is pivotably movable by means of a controllable lifting cylinder 71 on a separately reciprocably slidable sled 63 of a stationary guide 64. The sled 63 and the transport arrangement 12 are controlled by their own driving units 72, 73 i.e. drive motor, via the control unit 13.3. When it is required to transfer the ammunition while the vehicle is in a scewed position, there are provided at both sides of the running transport band 74 guide walls 75, whereby the stationary portion 12.1

(FIG. 2) of the transport arrangement 12 is also provided with such guide walls. The transport velocity of the transport band 74 of the transport arrangement 12 is additionally substantially increased by the reciprocable movement of the sled 63, whereby an extremely short loading period for the ammunition 2 of the weapons carrier 70 (FIG. 11) is achieved. For conveying into or out of the vehicle 5 the ammunition 2 the transport band 74 and the endless transport band of the continuously rotating transport arrangement 45 (FIG. 6) about the stationary portio 12.1 of the transport arrangement 12 (FIG. 6) is provided with entraining units 62 (FIG. 7).

FIG. 6 illustrates in detail the arrangement of the bridge crane 27 and the elevating mechanism 8 for the transporting of ammunition 2, stored in a prone position out of the containers 26, whereby the bridge crane 27, is movable over a pair of rails 28 which are respectively rigidly secured to opposite side walls 29. The bridge crane 27 consists of a movable traverse 30.2 which transverse is mounted on the pair of rails 28 and is movable by way of drive and support rollers 31 in the longitudinal vehicle direction 6. For purposes of controlling the height the arrangement arresting rollers 32 are provided on the rails 28. The rollers 32 are respectively mounted on the inner sides 33 of the rails 28. There is mounted on the traverse 30.2 a pair of rails 34 on which the carriage 35 is transversely movable in the transverse vehicle direction 7, whereby the carriage 35, is provided in addition with support and drive rollers 36, also for purposes of height control with arresting rollers 38 mounted on the inner side 40 of the rails 34. The carriage 35 includes in addition to the elevating mechanism 8 a control unit 13.2 and a drive unit 39 for driving the carriage 35 and the elevating mechanism 8. The elevating mechanism 8 is provided with a gripping arrangement 42 for gripping ammunition 2 stored in the containers 26 in a prone position. The gripping arrangement 42 is mounted at the lower end 41 of the carriage 35. This gripping arrangement includes at least two pairs of gripper arms 43 which are parallel to each other and horizontally spaced from each other along a direction corresponding to the longitudinal axis 11 of the vehicle and which two pairs of gripper arms 43 are movable in the vehicle transverse direction 7. The arms 46 of the gripper arrangement 42 are constructed in such a way that at least one projectile 14, but preferable two projectiles 14, respectively propellant charges 15 or cartridges 25 (FIG. 1), are lifted from a position which is parallel to the longitudinal axis 11 (FIG. 2) and in which position they are disposed in the containers 26 in a storage position 44 (FIG. 6). There is mounted at one side adjacent to the containers 26 and parallel to the longitudinal axis 11 of the vehicle (FIG. 2) underneath the traverse 30.2 in the operational region of the elevating mechanism 8 the extended stationary portion 12.1 of a transport arrangement 12. This transport arrangement comprises a continuously running endless band 45. The ammunition units 2 which are gripped by the gripper arrangement 42 are successively deposited on the stationary portion 12.1 of the transport arrangement 12 in a time-delayed fashion as a result of the configuration of the gripper arms 46 and as a result of the control of such gripper arm pairs 43, whereby the depositing, the renewed lifting and depositing of further ammunition 2 and the positioning into the inoperative position of the traverse 30.2 over the regions 23 or 24 of the storage chamber 1 (FIG. 1) can be effected.

For transporting vertically stored ammunition 2 as is illustrated in FIG. 7 there is used a traverse 30.1 which includes an elevating mechanism 8 that serves as a lifting, lowering and rotating gripping and swinging arrangement 47. This gripping and pivoting arrangement 47 consists substantially of semi-circularly shaped bent arms 49 which are joined to each other via a joining member 48, said arms 49 forming part of two mutually adjustable gripper pairs 52 and a control shaft 50 which lowers or lifts the joining member 48. The control shaft 50 assumes a horizontal position in the vehicle transverse direction 7, whereas the arms 49 are disposed, when the joining member 48 is in a vertical position, in the vehicle longitudinal direction 6, whereby the ammunition 2 stored vertically in the containers 26 after being rotated about an angle of 90° in a direction 51 about the axis of the control shaft 50 are deposited onto the transport arrangement 12 by the gripper pair arms 49 which face downwardly. There is mounted a driving unit 39 on the gripper and swinging arrangement 47 on the carriage 35, which is controlled by a control unit 13.1. The carriage 35 and the traverse 30.1 are drivable in a manner analogous to the description relating to the arrangement of FIG. 6. The traverse 30.1 however has an extremely low profile when compared to the traverse 30.2 (FIG. 6). The stationary portion 12.1 of the transport arrangement 12 (FIG. 2) is, however, arranged at the same height than in FIG. 6 above the traverse 30.1 in the operational region of the elevating mechanism 8 arranged on a side wall 29. Whereas the vertically stored ammunition 2 of the forward region 23 is directly deposited on the transport arrangement 12, the further transporting of the ammunition stored in the rearward region 24 (FIG. 2) which ammunition 2 is to be lifted out of the containers is grasped by the gripping and swinging arrangement 47 and is further transported via the stationary part 12.1 of the transport arrangement 12 (FIG. 2).

The elevating mechanism 8 (FIGS. 6 and 7) and the transport arrangement 12 (FIGS. 2, 4 and 5) contain respectively control units 13.1, 13.2, and 13.3 whereby the ammunition 2 can be grasped automatically in random sequence. The bridge cranes 27 are movable on the same rails 28 on behind the other in the vehicle 5 (FIG. 2) over the forward region 23 and the rearward region 24 (FIG. 6) to pick up identically stored ammunition 2, which is either stored vertically or in a prone position within the storage chamber 1 in the regions 23, 24 (FIG. 6). For the transportation of ammunition that is stored differently in the region 23 in a vertical position and in the region 24 (FIG. 6) in a prone position or vice versa the so-stored ammunition 2 can be seized by a gripper arrangement 42 (FIG. 6) mounted on a bridge crane 27 and a swinging and gripping arrangement 47 mounted on a bridge crane 27 which are movable on the same rails 28. In case that, for example, there is to be simultaneously lifted ammunition 2 stored in a prone position in the forward region 23 and in the rearward region 24, the delivery of the ammunition 2 from the gripper arrangement 42 (FIG. 6) is spaced in a timewise manner. With standing stored ammunition 2 it is possible, if necessary, to turn on the ignition and effect an ignition correction in the container 26, whereas with prone stored ammunition 2 these processes can be effected during the transporting towards the transport installation 12.1.

Figure 8:
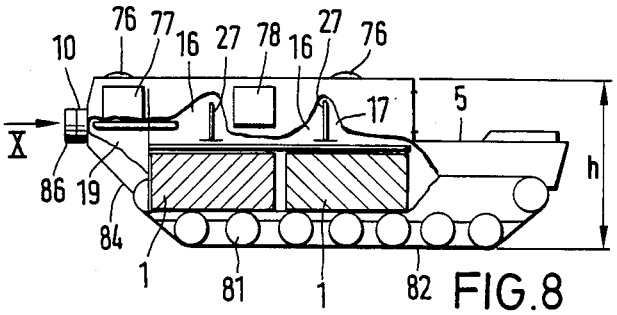
FIG. 8 is a schematic side-elevational view of the armored vehicle partially in section in the direction of the arrow VIII in FIG. 10.

FIG. 8 illustrates how, by disposing the storage chamber 1 very deeply, and by disposing the compact bridge cranes 27 above the storage chambers, there can be provided a vehicle construction having a low profile h and a favorable low center of gravity. This low silhouette of the vehicle makes it possible, taking into consideration the railroad transport dimensional limitations to structurally incorporate armored turrets 76 with integrated machine cannons which can be fired while having armor protection, whereby an armored turret 76 is available for the commander of the vehicle and a further one is mounted in the rear portion of the crew chamber 17. As a result of its low silhouette and the low disposition of the storage chamber 1 containing the ammunition 2 (FIG. 1) in the trough 91 (FIG. 3) an additional passive armor protection is achieved by way of the driving wheels 81, tract chain 82, motor and driving unit 83 and in the front as a result of the increased pass-through distance of the inclined or skewed front armor plate 84.

Figure 10:
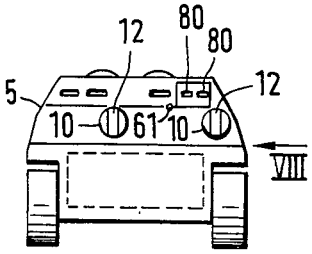
FIG. 10 is a front-elevational view of the vehicle of FIG. 8 in the direction of the arrow X.
Figure 9:
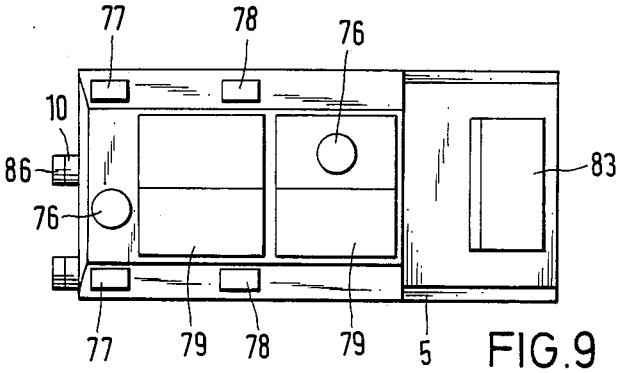
FIG. 9 is a plan view of the armored vehicle illustrated in FIG. 8.

The crew chamber 19 can, as can be noted from FIG. 9, be provided bilaterally with two doors 77 and the crew chamber 17 can also be provided with bilaterally arranged doors 78 which permit the crew to rapidly leave the vehicle. By means of upwardly swingable flaps 79 on the roof of the vehicle 5 the projectiles 14 (FIG. 1), propellant charges 15 (FIG. 1) or containers 26 (FIG. 6) holding the cartridged ammunition 25 (FIG. 1) can be inserted or exchanged from above by means of lifting and lowering mechanisms forming part of the vehicle or similar mechanisms which are, however, independent from the vehicle. With a closed turret 76 the vehicle has a 360° circular view for the vehicle driver and an additional frontal view by way of sighting means in the front of the vehicle. The driver has at his disposition additional sighting means 80, such a viewing slits, which provide for a front and lateral viewing with armor protection as is illustrated in FIG. 10. By means of suitable sensors 61 of the vehicle 5 and the weapon support carrier 70 (FIG. 11) the docking process can be introduced. The transport arrangements 12 can, by virtue of the adjustability of the lifting cylinder 71 (FIG. 4), be positioned to compensate for terrain deviations to a certain degree within a corresponding pipe 10, respectively 10.1 (FIG. 1), whereby the arrangement of square pipes 10, respectively 10.1 (FIG. 11), is also possible.

FIG. 11 illustrates the vehicle 5 in a docked condition with a weapons carrier 70 having a separate turret 85. Depending on the position of the turret 85 the ammunition transfer can advantagecusly be effected from three sides. The pipes 10, 10.1 have the same armor plate protection as the vehicle 5 and include in the front a deformable sealing ring 86 for sealing the inner pipe volume, whereby during ammunition transfer a limited CBR-safety is achieved.

Figure 12:
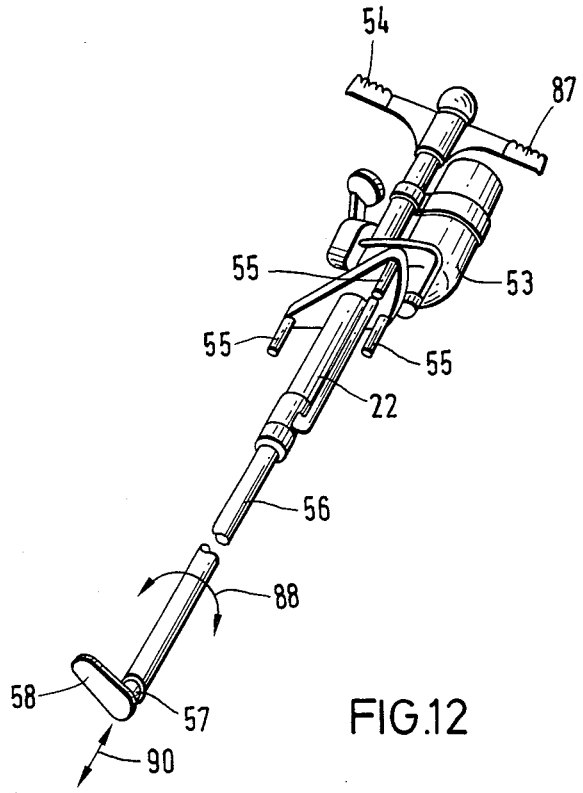
FIG. 12 is a perspective view of the special tool for manually lifting vertically stored ammunition.
Figure 13:
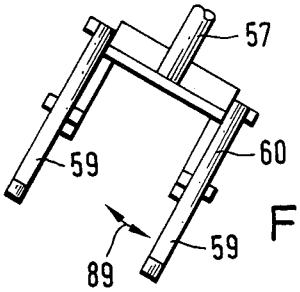
FIG. 13 is a front-elevational view of a gripper pair of the special tool for manually lifting the stored ammunition.

In the event of energy supply failure the bridge cranes 27 can be manually moved, so that a special tool 22, corresponding to what is illustrated in FIGS. 12, respectively 13, can be used with its own energy supply for lifting the ammunition 2 (FIG. 1). This special tool 22 consists of a pressurized pneumatic medium tank 53 having a control arrangement 54, a container attachment 55 and a rotating, lifting and lowering ammunition elevating mechanism 56. The ammunition elevating mechanism 56 serves for lifting vertically stored ammunition 2 (FIG. 7) by seizing it with a foot portion 58 which is rotatable about its own axis at the lower end 57 of the elevating mechanism 56 or for purposes of lifting pronepositioned ammunition 2 (FIG. 6) by seizing it by means of mutually movable gripper claws 59 of a gripper pair 60 which can be mounted on the elevating mechanism 56. The foot 58 is, by pivoting a hand grip portion 87, rotated in the direction 88 and grips thereby underneath the bottom of the vertically stored ammunition 2 (FIG. 7). By means of independent energy supply of the special tool 22 the ammunition 2 is during the working stroke pulled out of the container 26 (FIG. 7) and is manually transported to the transport arrangement 12. With prone-stored ammunition 2 (FIG. 6) the gripper pairs grasps the ammunition 2 by movement of the gripper claws 59 in a direction 89 so that thereafter the ammunition can be lifted in a direction 90 and can be conveyed for further transportation.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. An improved self-propelled a.t.a. vehicle for transporting ammunition including ammunition moved by a motor driven conveyor having elevating means for selectively vertically moving ammunition units stored in said a.t.a. vehicle, motor-driven first ammunition unit conveying means for selectively conveying said ammunition units deposited by said elevating means thereon through an opening in said a.t.a. vehicle towards a second weapons carrier armored vehicle, said a.t.a. vehicle also including a crew chamber for accommodating a crew for said a.t.a. vehicle, the improvement comprising (a) vehicle transport means for moving said a.t.a. vehicle on the ground, a storage chamber disposed in the bottom region of said a.t.a. vehicle between said vehicle transport means and in the middle region of said a.t.a. vehicle;

(b) at least one ammunition unit elevating mechanism of said elevating means is operatively mounted in said a.t.a. vehicle for movement relative to said a.t.a. vehicle in the longitudinal and transverse direction;

(c) said first conveying means including a conveying mechanism which is reciprocally slidably operatively mounted in said a.t.a. vehicle above said storage chamber and which extends parallel to the longitudinal axis of the a.t.a. vehicle, and pipe means being mounted on the front side of said a.t.a. vehicle in communication with said opening, said conveying mechanism is slid forwardly through said opening and said pipe means towards a weapons carrier armored vehicle, said pipe means rendering armor-protection to the ammunition units being tranported therethrough;

(d) control means operatively connected to said elevating mechanism and conveying mechanism for lifting preselected ammunition units from said storage chamber and transporting them through said pipe means;

(e) said elevating mechanism extending into an upper region of said chamber which forms an operations chamber for said a.t.a. vehicle, said same upper region also forms an auxiliary crew chamber during travel of said a.t.a. vehicle; and (f) said a.t.a. vehicle having a crew chamber disposed above and in front of said storage chamber and said a.t.a. vehicle having a front wall and roof which define said crew chamber.

2. The improvement in a self-propelled armored vehicle as set forth in claim 1, wherein (a) said stroage chamber includes at least a front region and a rear region, said front region holds the heavier ammunition units, whereas said rear region being adapted to hold the lighter ammunition units;

(b) including a plurality of exchangeable prism-shaped containers being disposed in said storage chamber, said ammunition units being mounted in said containers; and (c) telescopically slidable wall means operatively mounted in said a.t.a. vehicle between said storage chamber and crew chamber for protecting said ammunition units stored in said storage chamber against damage and soiling.

3. The improvement in a self-propelled armored vehicle as set forth in claim 2, wherein (a) said crew chamber is divided into a plurality of partial crew chambers;

(b) a first one of said partial crew chambers includes first seating means for the driver of said a.t.a. vehicle, a second one of said partial crew chambers includes second seating means and a standing room for the commander of said a.t.a. vehicle, and a third one of said partial crew chambers includes third seating means for an auxiliary crew member;

(c) at least one conveying mechanism of said first conveying means being disposed at one side of said first and second partial crew chambers;

(d) said ammunition unit elevating mechanism and said conveying mechanism can be serviced by a crew member located either in the first or second partial crew chamber.

4. The improvement in a self-propelled armored vehicle as set forth in claim 3, wherein an auxiliary fuel tank and auxiliary driving means are operatively mounted in said a.t.a. vehicle below said crew chamber.

5. The improvement in a self-propelled armored vehicle as set forth in claim 4, wherein (a) said ammunition elevating means include a first pair of rails mounted on opposite side walls of said a.t.a. vehicle, at least one bridge crane movably mounted on said pair of first rails;

(b) said bridge crane including a transverse, first wheel means operatively mounted at opposite ends of said traverse for movably supporting said traverse on said first pair of rails, and second wheel means for defining the elevation of the traverse in a.t.a armored vehicle;

(c) a second pair of rails mounted on said traverse, a carriage reciprocally movably mounted on said second pair of rails, said carriage having third and fourth wheel means for respectively movably supporting and elevation-defining said carriage on said second pair of rails; whereby (d) said elevating mechanism, said control means and driving means for driving said carraige and elevating mechanism are operatively mounted on said carriage.

6. The improvement in a self-propelled armored vehicle as set forth in claim 5, (a) wherein said elevating means include two bridge cranes movable mounted on said pair of first rails, a first one of said two bridge cranes coacts with the front region of said storage chamber and a second one of said two bridge craines is adapted to coact with a rear region of said storage chamber for speeding up the conveyance of ammunition units from the storage chamber to the conveying mechanism;

(b) said first and second bridge cranes being mounted one behind the other on said pair of first rails;

(c) said first and second bridge cranes being jointly or separably movable on the same pair of first rails over the forward and rear regions of said storage chamber.

7. The improvement in a self-propelled armored vehicle as set forth in claim 6, wherein (a) when all of said ammunition units are stored in the same position each bridge crane has identical elevating means mounted thereon;

(b) whereas when said ammunition units are stored in vertical and horizontal positions in said storage chamber one of said bridge cranes supports an elevating mechanism having gripping means and the other bridge crane supports an elevating mechanism having combination gripping and swinging mechanism.

8. The improvement in a self-propelled armored vehicle as set forth in claim 9, wherein said conveying means include a slidable conveying mechanism for each bridge crane, the conveying mechanism for the front bridge crane is operatively mounted in said a.t.a. vehicle between said first and second partial crew chambers and the conveying mechanism for said rear bridge crane is operatively mounted in said a.t.a. vehicle between said third partial crew chamber and the side wall of said crew chamber; said conveying mechanisms transporting ammunition units in a direction parallel to the longitudinal direction of said a.t.a. vehicle.

9. The improvement in a self-propelled armored vehicle as set forth in claim 8, wherein (a) each conveying mechanism includes at least one stationary and one movable portion, said movable portion being slidable in a direction parallel to the longitudinal direction of the a.t.a. vehicle for conveying ammunition units through a corresponding opening in said a.t.a. vehicle;

(b) said stationary portion is disposed underneath the level of the corresponding traverse of the coacting bridge crane for the gripping means and, on the other hand, above the level of the corresponding traverse of the coacting bridge crane for the combination gripping and swinging mechanism;

(c) the stationary portion of said conveying mechanism includes an endlesss transportation band and driving means for driving said endless transportation band.

10. The improvement in a self-propelled armored vehicle as set forth in claim 9, wherein (a) each one of said conveying mechanisms includes means for pivoting and driving said slidable movable portion relative to said stationary portion;

(b) said slidable movable portion of each conveying mechanism is operatively mounted on fixed guide portion of said a.t.a. vehicle.

11. The improvement in a self-propelled armored vehicle as set forth in claim 10, wherein said opening in said a.t.a vehicle through which the ammunition units are transported is disposed in the front wall of said a.t.a. vehicle, a hatch cover is movably mounted on the inner side of said front wall and generally covers said opening when said slidably movable portion of said conveying mechanism does not extend therethrough.

12. The improvement in a self-propelled armored vehicle as set forth in claim 10, wherein said hatch cover is pivotally mounted on the inner side of said front wall.

13. The improvement in a self-propelled armored vehicle as set forth in claim 11, wherein said hatch cover is slidably mounted on the inner side of said front wall.

14. The improvement in a self-propelled armored vehicle as set forth in claim 11, including sensing means operatively mounted on the front wall of said a.t.a. vehicle for sensing the correct alignment between said a.t.a. vehicle and an armored weapons carrier vehicle for purposes of docking the two vehicles.

15. The improvement in a self-propelled armored vehicle as set forth in claim 14, wherein (a) including a special ammunition lifting tool when the energy supply for the driving means for driving the carriage is interrupted said lifting tool having self-contained energy supply means mounted thereon;

(b) said energy supply means including a pressurized medium container and ammunition unit gripping, rotating and elevating means operatively connected therewith;

(c) said ammunition unit gripping, rotating and elevating means having an exchangeable portion which either includes lifting means or gripping means.

16. The improvement in a self-propelled armored vehicle as set forth in claim 5, wherein (a) including gripping emans being operatively mounted at the lower end of said elevating mechanism for gripping ammunition units stored in said ammunition storage chamber;

(b) said gripping means having at least two pairs of parallel first gripper arms which are spaced from each other in the longitudinal direction of the a.t.a. vehicle and which are reciprocally movable in a direction transverse to the longitudinal direction of the a.t.a. vehicle;

(c) the free ends of each gripper arm of said two pairs of first gripper arms being constructed and shaped so as to grip at least one ammunition unit stored in one of said containers parallel to the longitudinal direction of the a.t.a. vehicle;

(d) gripping means sequentially deposit said ammunition units held by its first gripper arms onto said conveying mechanism in a predetermined time sequence.

17. The improvement in a self-propelled armored vehicle as set forth in claim 5, wherein (a) said elevating mechanism includes a combination gripping and swinging mechanism for gripping vertically stored ammunition units;

(b) said combination gripping and swinging mechanism including at least two pairs of second semi-circular shaped reciprocally movable gripper arms, a joining member, and a swing shaft, said joining member operatively supporting two pairs of second gripper arms and being fixed to said swing shaft;

(c) said swing shaft assuming a horizontal position in a direction transverse to the longitudinal direction of the a.t.a. vehicle when said joining member is in a vertical position, whereby said two pairs of second semi-circular gripper arms assume also a vertical position in the longitudinal direction of said a.t.a. vehicle so that the vertically stored ammunition units are gripped by said two pairs of second gripper arms after the joining member has been rotated an angle of 90° by said swing shaft, elevated by said combination gripping and swinging mechanism and deposited on said conveying mechanism.

* * * * *